US009518700B2

(12) United States Patent
Herry et al.

(10) Patent No.: US 9,518,700 B2
(45) Date of Patent: Dec. 13, 2016

(54) IMPERMEABLE AND THERMALLY INSULATED TANK COMPRISING A METAL MEMBRANE THAT IS CORRUGATED IN ORTHOGONAL FOLDS

(71) Applicant: GAZTRANSPORT ET TECHNIGAZ, Saint Remy les Chevreuse (FR)

(72) Inventors: Mickael Herry, Massy (FR); Johan Bougault, Jouy en Josas (FR); Antoine Philippe, Gif sur Yvette (FR); Benjamin Charpentier, Paris (FR)

(73) Assignee: Gaztransport Et Technigaz (FR)

( * ) Notice: Subject to any disclaimer, the term of this patent is extended or adjusted under 35 U.S.C. 154(b) by 0 days.

(21) Appl. No.: 14/434,634

(22) PCT Filed: Oct. 9, 2013

(86) PCT No.: PCT/FR2013/052411

§ 371 (c)(1),
(2) Date: Apr. 9, 2015

(87) PCT Pub. No.: WO2014/057221

PCT Pub. Date: Apr. 17, 2014

(65) Prior Publication Data

US 2015/0285439 A1 Oct. 8, 2015

(30) Foreign Application Priority Data

Oct. 9, 2012 (FR) ..... 12 59622

(51) Int. Cl.
*B63B 25/16* (2006.01)
*F17C 3/02* (2006.01)
(Continued)

(52) U.S. Cl.
CPC ..... *F17C 3/027* (2013.01); *B63B 25/16* (2013.01); *F17C 3/04* (2013.01); *F17C 6/00* (2013.01);
(Continued)

(58) Field of Classification Search
CPC ..... B63B 25/08; B63B 25/16; B63B 25/14; F17C 3/02; F17C 3/027; F17C 3/04; F17C 6/00; F17C 9/00; F17C 13/001
(Continued)

(56) References Cited

FOREIGN PATENT DOCUMENTS

| | | |
|---|---|---|
| FR | 2724623 | 3/1996 |
| KR | 10-0760481 B1 † | 9/2007 |

(Continued)

*Primary Examiner* — Lars A Olson
(74) *Attorney, Agent, or Firm* — Berenato & White, LLC

(57) ABSTRACT

An impermeable and thermally insulated tank built into a load-bearing structure, the tank wall comprising:

a thermally insulated barrier attached to a load-bearing wall and made of insulated blocks, juxtaposed in parallel rows separated from one another by gaps, an impermeable barrier supported by the thermally insulated barrier and made of welded metal sheets.

Each insulated block carries, on the face of same opposite the load-bearing wall, two metal connecting strips arranged in parallel to the sides of the insulated block. The sheets of the membrane carried by the insulated block are welded to the strips. The connecting strips are rigidly connected to the insulated block carrying same. The sheets each have at least two orthogonal folds parallel to the sides of the insulated blocks, the folds being inserted into the gaps formed between two insulated blocks.

31 Claims, 11 Drawing Sheets

(51) Int. Cl.

| | |
|---|---|
| ***F17C 3/04*** | (2006.01) |
| ***F17C 6/00*** | (2006.01) |
| ***F17C 9/00*** | (2006.01) |
| ***F17C 13/00*** | (2006.01) |

(52) U.S. Cl.

CPC ..... *F17C 9/00* (2013.01); *F17C 13/001* (2013.01); *F17C 2201/0157* (2013.01); *F17C 2201/052* (2013.01); *F17C 2203/0333* (2013.01); *F17C 2203/0354* (2013.01); *F17C 2203/0358* (2013.01); *F17C 2203/0631* (2013.01); *F17C 2203/0643* (2013.01); *F17C 2203/0648* (2013.01); *F17C 2203/0651* (2013.01); *F17C 2205/0355* (2013.01); *F17C 2205/0364* (2013.01); *F17C 2205/0367* (2013.01); *F17C 2209/221* (2013.01); *F17C 2209/227* (2013.01); *F17C 2209/228* (2013.01); *F17C 2209/232* (2013.01); *F17C 2221/033* (2013.01); *F17C 2223/0161* (2013.01); *F17C 2223/033* (2013.01); *F17C 2270/0107* (2013.01); *F17C 2270/0113* (2013.01); *F17C 2270/0123* (2013.01); *F17C 2270/0136* (2013.01)

(58) Field of Classification Search

USPC ..... 114/74 A, 74 R

See application file for complete search history.

(56) References Cited

FOREIGN PATENT DOCUMENTS

| | | | | | |
|---|---|---|---|---|---|
| KR | 100760481 | B1 | * | 9/2007 | ..... F17C 5/02 |
| KR | 20100090036 | | | 8/2010 | |
| KR | 10-2012-0013256 | A | † | 2/2012 | |
| KR | 10-1088464 | B1 | † | 12/2012 | |
| WO | 2008/147003 | A1 | † | 12/2008 | |
| WO | W02008147003 | | | 12/2008 | |

* cited by examiner

† cited by third party

IMPERMEABLE AND THERMALLY INSULATED TANK COMPRISING A METAL MEMBRANE THAT IS CORRUGATED IN ORTHOGONAL FOLDS

CROSS-REFERENCE TO RELATED APPLICATIONS AND CLAIM TO PRIORITY

This application is a national stage application of International Application No. PCT/FR2013/052411 filed Oct. 9, 2013, which claims prrority to French Patent Application No. 1259622 filed Oct. 9, 2012, of which the disclosures are incorporated herein by reference and to which priority is claimed.

FIELD OF THE INVENTION

The present invention relates to an impermeable and thermally insulated tank, and in particular the present invention relates to tanks designed to contain cold liquids, for example tanks for storing and/or transporting liquefied gases by sea.

BACKGROUND OF THE INVENTION

Impermeable and thermally insulated tanks can be used in different industries to store hot or cold products. For example, in the field of energy, liquefied natural gas (LNG) is a liquid that can be stored at atmospheric pressure at approximately −163° C. in onshore storage tanks or in tanks carried on board floating structures.

Such a tank is described, for example, in document FR-A-2724623.

SUMMARY OF THE INVENTION

According to one embodiment, the invention provides an impermeable and thermally insulated tank built into a structure that includes a load-bearing wall, said tank having a tank wall attached to said load-bearing wall, the tank wall comprising:

- a thermally insulated barrier attached to the load-bearing wall and made of cuboid shaped insulated blocks, juxtaposed in parallel rows separated from one another by gaps;
- an impermeable barrier supported by the thermally insulated barrier, the impermeable barrier comprising a metal membrane formed of metal sheets welded together in an impermeable manner;
- each insulated block of the thermally insulated barrier carrying, on the face opposite the load-bearing wall, at least two substantially orthogonal metal connecting strips, arranged parallel to the sides of the insulated blocks, the sheets of the metal membrane carried by the insulated blocks being welded to the strips, the connecting strips being rigidly connected to the insulated blocks bearing same;
- a plurality of sheets of the metal membrane each having at least two orthogonal folds parallel to the sides of the thermally insulated blocks, said folds being inserted in the gaps formed between the insulated blocks.

According to the invention, such tank may have one or more of the following features.

According to an embodiment, the sheets of the metal membrane each have at least two orthogonal folds parallel to the sides of the thermally insulated blocks, inserted in the gaps formed between the insulated blocks.

According to an embodiment, the tank wall has a primary element and a secondary element arranged between the load-bearing wall and the primary element, both the primary element and the secondary element including a thermally insulated barrier made up of cuboid insulated blocks, juxtaposed in parallel rows and an impermeable barrier arranged on the thermally insulated barrier, the thermally insulated barrier of the secondary element being rigidly connected to the load-bearing wall, the thermally insulated barrier of the primary element being rigidly connected using attaching means connected to the thermally insulated barrier of the secondary element.

According to an embodiment, the impermeable barrier of the secondary element is formed by the metal membrane comprising a plurality of sheets each having at least two orthogonal folds parallel on the sides of the thermally insulated blocks, inserted in the gaps formed between the insulated blocks of the secondary element.

According to an embodiment, the sheets of the metal membrane of the secondary element are made of an alloy of iron with nickel or manganese, having a coefficient of expansion not exceeding $7\times10^{-6}$ $K^{-1}$.

According to an embodiment, the folds of the metal sheets of the secondary impermeable barrier are inserted into the gaps between the insulated blocks of the thermally insulated barrier of the secondary element.

According to an embodiment, the folds of the metal sheets of the primary impermeable barrier are inserted into the gaps between the insulated blocks of the thermally insulated barrier of the primary element. According to other embodiments, the primary membrane may have a different design from the secondary membrane, for example with folds projecting into the tank. In other words, the impermeable barrier of the primary element is formed of metal sheets welded together in an impermeable manner, with folds oriented towards the inside of the tank.

According to an embodiment, an insulated block of the thermally insulated barrier has a base plate on which is arranged a foam layer, in particular a polyurethane foam, the base plate overhanging the foam. The plates may be made of plywood. The secondary element is held against the load-bearing wall using fixtures welded to the load-bearing wall and cooperating with the overhanging areas of the plates of the insulated block, optionally with the interposition of a resin bead to correct any localized imperfections in the load-bearing wall.

According to an embodiment, an insulated block of the thermally insulated barrier of the secondary element is held on the load-bearing wall by bonding.

Numerous different arrangements of the connecting strips on the insulated blocks are possible, in particular with regard to the position and the number of connecting strips on an insulated block. In this regard, the insulated blocks are not necessarily all identical.

According to an embodiment, the connecting strips of each insulated block of the thermally insulated barrier of the secondary element carries two connecting strips that are arranged along the two axes of symmetry of a rectangle defined by the large face of said insulated block.

According to an embodiment, the connecting strips of each insulated block of the thermally insulated barrier of the primary element are arranged in the vicinity of the edges of the large face of the insulated block.

According to an embodiment, an insulated block has three connecting strips arranged on the cover plate.

According to an embodiment, the connecting strips of an insulated block are seated in recesses formed in the plate or the foam layer bearing same so as not to increase the thickness on the corresponding face of the insulated block.

According to an embodiment, a connecting strip of an insulated block is attached to the recess of same by screwing, stapling, riveting or bonding.

According to an embodiment, the attachment means of the thermally insulated barrier of the primary element include a continuous metal plate arranged at the crossing of two connecting strips of each insulated block of the secondary element, and a projecting member crossing the impermeable barrier of the secondary element without reaching the impermeable barrier of the primary element.

According to an embodiment, the adjacent metal sheets of the impermeable barriers of the primary and secondary elements are welded such as to overlap with the connecting strips carried respectively by the thermally insulated barriers of the primary and secondary elements.

According to an embodiment, the projecting members are studs, the bases of which are attached to the continuous metal plate of the insulated block of the secondary element, an intermediate part being interposed between, on the one hand, a nut cooperating with the thread provided at the free extremity of the stud and on the second hand, with the overhanging parts of the plates of the insulated blocks of the thermally insulated barrier of the primary element. The bases of the studs are attached by welding and/or screwing to the continuous metal plate of the insulated block of the secondary element.

According to an embodiment, the sheets of the metal membranes, which form the impermeable barrier, are rectangular and each have two folds formed along the axes of symmetry of the rectangle formed by the edges of same.

According to an embodiment, the two folds of a sheet and the impermeable barrier of the primary element intersect at the center of the rectangular sheet.

According to an embodiment, one of the folds of a sheet is continuous and the other is interrupted in the central portion of same.

According to an embodiment, the sheets of a first type have a continuous fold along the major axis of same.

According to an embodiment, the sheets of a second type have a discontinuous fold along the major axis of same.

According to an embodiment, on one tank wall, the sheets of the first and second types are regularly alternated so that a sheet of one of the types is always adjacent to a sheet of the other type.

According to an embodiment, each insulated block of the thermally insulated barrier has two series of orthogonal slots, each of the series having slots arranged parallel to two opposing sides of the insulated block, and the sheets of the metal membrane each having two series of supplementary folds, each of the series of supplementary folds having folds orthogonal to the folds in the other series, parallel to one of the two folds inserted in the gaps, and inserted in the slots of one of the series of slots formed in the insulated block.

According to another embodiment, the metal membrane has a second plurality of sheets, each of the sheets in the second plurality having a single fold parallel to two opposing sides of the insulated blocks, said fold being inserted into a gap formed between two insulated blocks.

According to another embodiment, each insulated block of the thermally insulated barrier has a slot parallel to two opposing sides of the insulated blocks and in which the metal membrane has a second plurality of sheets, each of the sheets in the second plurality having a fold inserted in a slot formed in an insulated block and a fold inserted in a gap formed between two insulated blocks.

Such a tank may be part of an onshore storage facility, for example for storing LNG, or be installed on a coastal or deep-water floating structure, notably an LNG carrier ship, a floating storage and regasification unit (FSRU), a floating production, storage and offloading (FPSO) unit, among others.

According to an embodiment, a ship used to transport a cold liquid product has a double hull and the aforementioned tank arranged in the double hull.

According to an embodiment, the invention also provides a method for loading onto or offloading from such a ship, in which a cold liquid product is channeled through insulated pipes to or from an onshore or floating storage facility to or from the tank on the ship.

According to an embodiment, the invention also provides a transfer system for a cold liquid product, the system including the aforementioned ship, insulated pipes arranged to connect the tank installed in the hull of the ship to an onshore or floating storage facility and a pump for driving a flow of cold liquid product through the insulated pipes to or from the onshore or floating storage facility to or from the tank on the ship.

An idea at the heart of the invention is to provide an impermeable and insulated multi-layer structure that is easy to build over large surfaces. Certain aspects of the invention are based on the idea of building insulated blocks that have simple geometry and are inexpensive to manufacture. Certain aspects of the invention are based on the idea of providing an impermeable membrane, in particular a secondary membrane made of steel sheet with a low coefficient of expansion, for example Invar® (known generically as 64FeNi) or other, of limited thickness, in particular not exceeding 0.7 mm, thereby achieving limited stiffness which enables anchoring at the edges of the tank wall using relatively small anchoring means.

The invention is further explained, along with additional objectives, details, characteristics and advantages thereof, in the detailed description below of several specific embodiments of the invention given solely as non-limiting examples, with reference to the drawings attached.

DETAILED DESCRIPTION OF THE PREFERRED EMBODIMENTS

Figure 1:
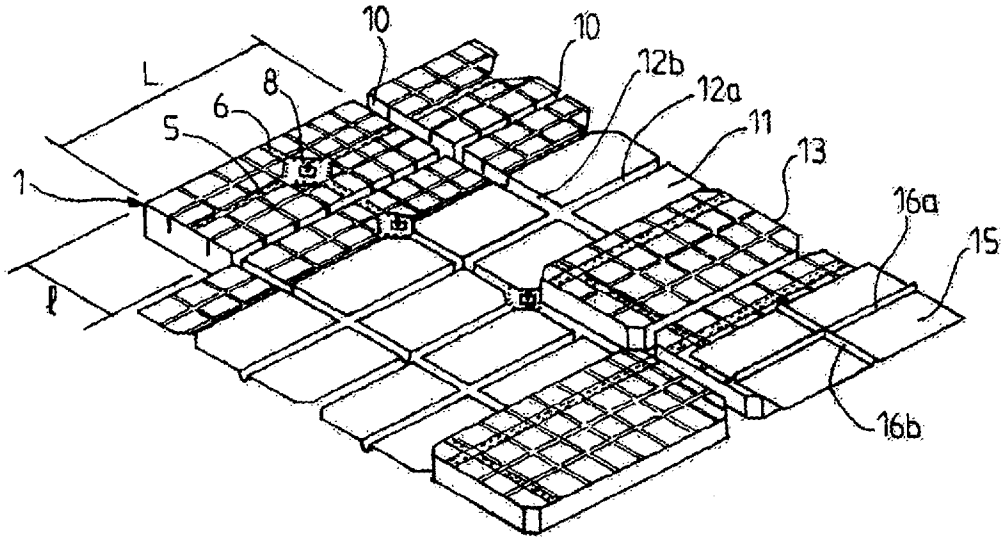
FIG. 1 is a schematic perspective view of an assembly of different members forming an impermeable and thermally insulated tank according to the invention: this general view includes the different parts removed to reveal the impermeable and thermally insulated barriers of the primary and secondary elements of the tank wall.

In the different variants shown in the drawings, the components that perform the same function have been identified using the same reference signs, even if the implementation of same is not identical.

In the drawings, reference sign 1 refers, as a whole, to an insulated block of the thermally insulated barrier of the secondary element of a tank wall. The block has a length L and a width I, for example, respectively, 3 and 1 m; it has a cuboid shape and it is made of polyurethane foam between two plywood plates. One of the plates 2*a* overhangs the edge of the foam and is intended to bear against the load-bearing wall 3 with the interposition of resin beads 4 designed to correct the local defects in the load-bearing wall 3. The other plate 2*b* of the insulated block 1 includes, along the two axes of symmetry of same, a metal connecting strip 6, which is placed in a recess 7 and which is attached there using screws, rivets, staples or adhesive. In the crossing zone of the strips 5 and 6 there is a continuous metal plate, which bears, at the center of the crossing of the strips, a stud 8 projecting above the plate 2*b*. The plate 2*a* is held on the load-bearing wall 3 by bonding using resin beads 4, as well as using studs 9 welded onto the load-bearing wall 3. A gap 10 is formed between two adjacent blocks 1, for example caused by the presence of the overhanging parts of the plate 2*a*, or potentially using positioning blocks.

As shown in FIG. 1, starting with the uncovered secondary insulated block shown in the top left of the figure and moving in an oblique direction downwards and to the right, the perspective shows a secondary insulated block 1 that is partially covered by a sheet 11 forming a part of the secondary impermeable barrier of the tank wall. This metal sheet 11 has a substantially rectangular shape and includes, along each of the two axes of symmetry of this rectangle, a fold 12*a*, respectively 12*b*. The folds 12*a* and 12*b* form reliefs oriented towards the load-bearing wall 3 and are seated in the gaps 10 in the secondary insulation barrier. The metal sheets 11 are made of Invar®, the coefficient of thermal expansion of which is typically between $1.5\times10^{-6}$ and $2\times10^{-6}$ $K^{-1}$. They have a thickness of between approximately 0.7 mm and approximately 0.4 mm. Two adjacent sheets 11 are welded together in an overlapping manner, as described in FIGS. 5 and 6. The sheets 11 are held on the insulated blocks 1 using the strips 5 and 6 to which at least two edges of the sheets 11 are welded.

According to a preferred embodiment, the metal sheets 11 are made of a manganese-based alloy having a coefficient of thermal expansion substantially equal to $7\times10^{-6}$ $K^{-1}$. Such alloys are usually less expensive than alloys with a high nickel content, such as Invar®.

Figure 4:
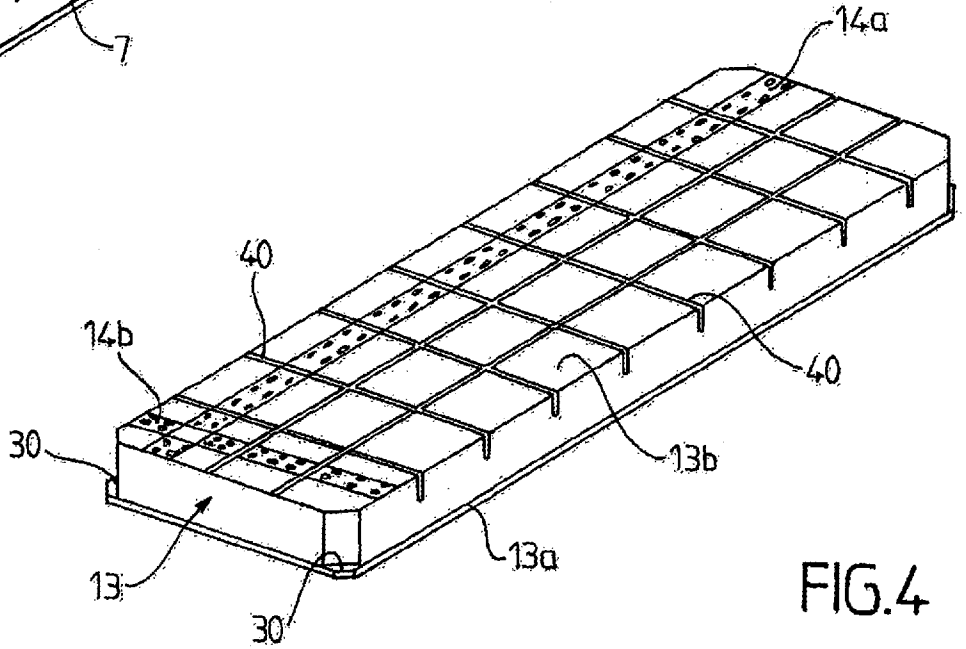
FIG. 4 is a perspective view of an insulated block of the thermally insulated barrier of the primary element of the wall of the tank in FIG. 1.

With reference to FIG. 1, moving obliquely to the right and downwards from the zone in which the metal sheets 11 of the impermeable barrier of the secondary element of the tank wall, there is a zone in which the secondary impermeable barrier is covered by an insulated block 13 of the thermally insulated barrier of the primary element of the tank wall. The insulated block 13 is shown in detail in FIG. 4. This block has an overall structure similar to the structure of block 1, i.e. a sandwich formed by polyurethane foam between two plywood plates. The base plate 13*a*, which is supported by metal sheet 11, has overhanging parts 30 at the four corners. These insulated blocks 13 are attached using the overhanging parts 30 and the studs 8. On the upper face of the insulated block 13 there are two connecting strips 14*a*, 14*b*; these connecting strips are made of metal and arranged in the recesses formed in the insulated block 13 so as not to increase the thickness of this insulated block. The two strips 14*a*, 14*b* are arranged in parallel to the edges of the block 13 and they are attached in the recesses of same, as described above for strips 5 and 6.

Figure 2:
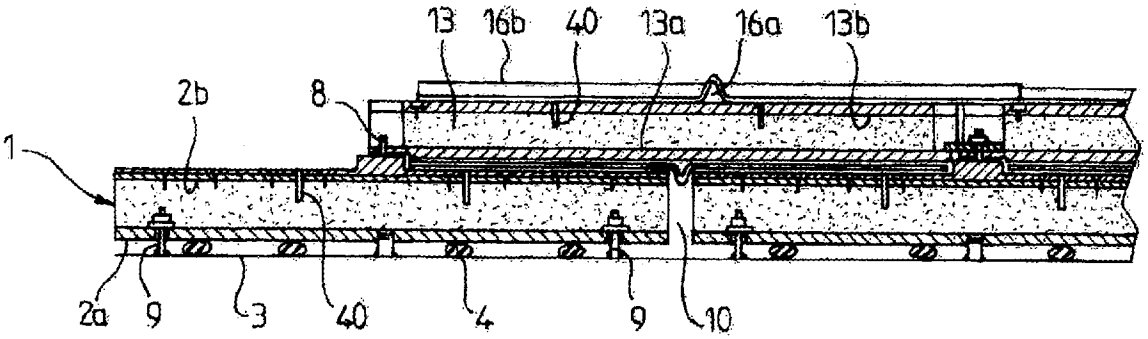
FIG. 2 is a schematic representation of a cross-section of a tank wall according to the invention, in which the primary impermeable barrier has folds projecting from the side opposite the load-bearing wall.
Figure 3:
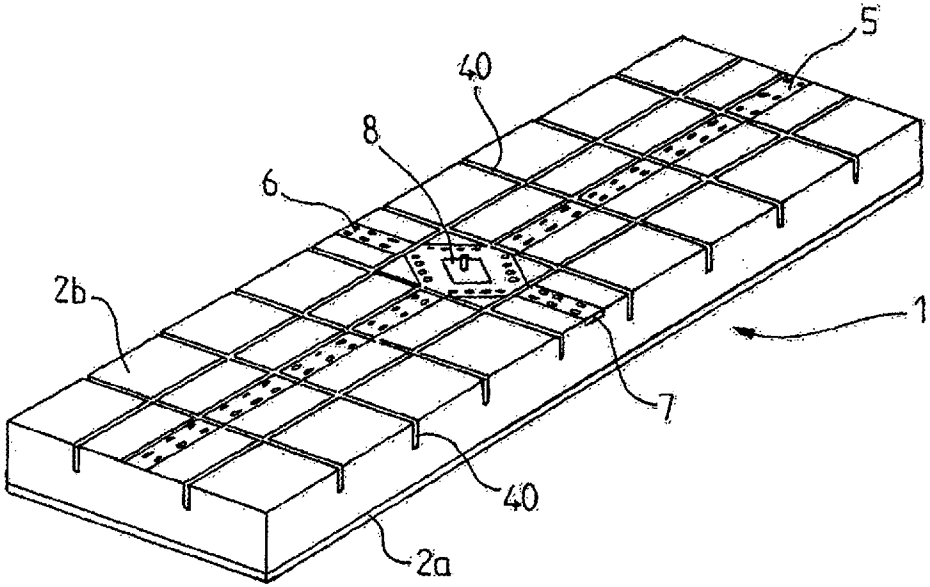
FIG. 3 is a perspective view of an insulated block of the thermally insulated barrier of the secondary element of the wall of the tank in FIG. 1, the block having, in the central zone of same, attachment means for the insulated blocks of the thermally insulated barrier of the primary element of the wall of the tank.

Finally, FIG. 1 shows, when moving from element 13 obliquely downwards and to the right, the placement of a metal sheet 15 forming the impermeable barrier of the primary element of the tank. This sheet 15 may be made of stainless steel with a thickness of approximately 1.2 mm; it includes folds formed along the axes of symmetry of the rectangle that it forms, as already described for the metal sheets 11. These folds may be in relief on the side of the load-bearing wall 3, but they may also be in relief towards the inside of the tank; these folds are identified as 16*a*, 16*b*. In FIG. 2, as in FIGS. 5 and 6, the folds 16*a*, 16*b* are oriented towards the inside of the tank.

Figure 5:
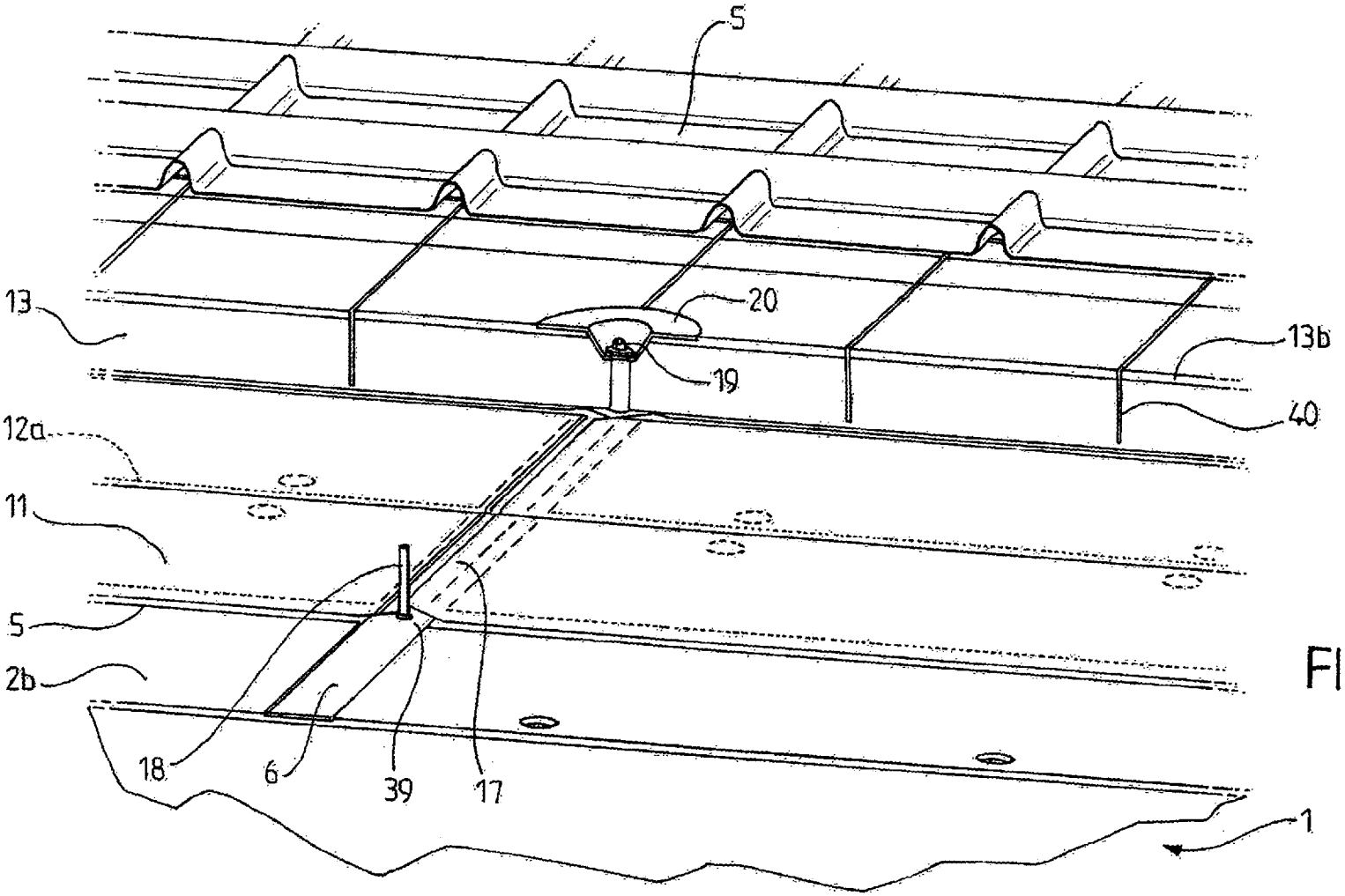
FIG. 5 is a cut-away perspective view of the parts making up the impermeable and thermally insulated barriers of the primary and secondary elements of a tank wall according to the invention including, in the impermeable barrier of the primary element of same, folds projecting into the tank as shown in FIG. 2, FIG. 5 showing in detail the construction of the attachment means for the primary insulation barrier on a connecting strip of the secondary insulation barrier.
Figure 6:
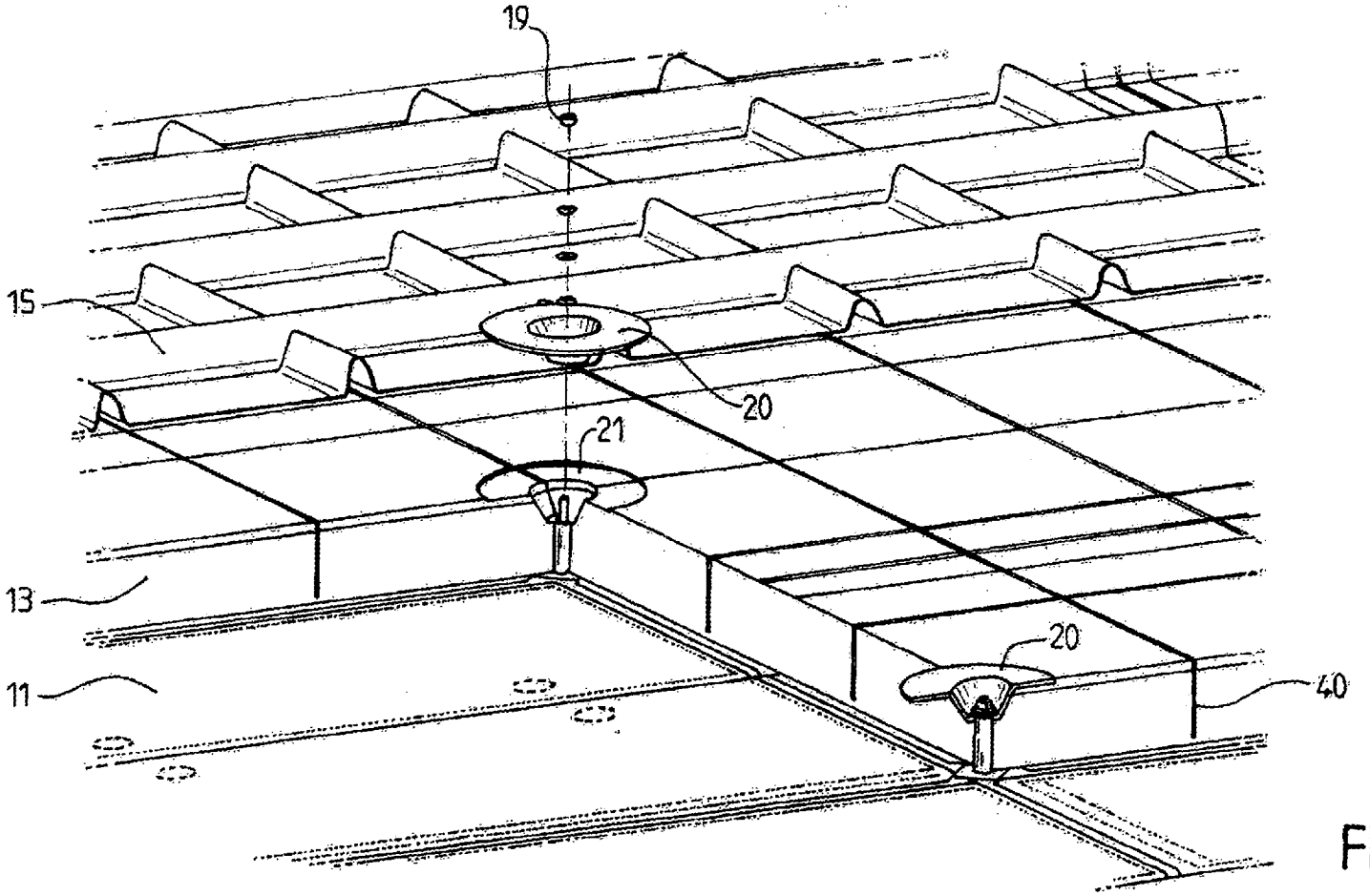
FIG. 6 is a view similar to FIG. 5, in which two parts of attachment means are shown individually in an exploded view.

FIGS. 5 and 6 show an embodiment in which the metal sheets 11 have a fold 12*a* arranged inside a gap 10 and shown using a dotted line. The adjacent sheets of the secondary impermeable barrier are welded in an overlapping manner, the weld zone being identified using reference sign 17. The weld is formed on the connecting strip 6, which also bears the studs 18 welded to the base of same on the strip 6 and threaded at the upper extremity of same to cooperate with a locking bolt 19. This locking bolt is placed at the base of a bowl, the peripheral edge 20 of which rests in a recess 21 formed in the plywood plate 13*b*, which delimits the primary insulation barrier 13 towards the inside of the tank. Upon the primary insulated block is placed a sheet 15 that has two lines of folds in relief towards the inside of the tank, the orthogonal folds meeting to form nodes; the sheets 15 are welded sealingly and form the primary impermeable barrier of the tank.

The connecting strip 6 is continuous at the intersection with the connecting strip 5 such as to form an impermeable zone 39 to which the corners of four sheets 11 can be welded around the stud 18. As such, there is no need to perforate a sheet 11 to enable the stud 18 to pass through towards the primary element of the tank wall. Throughout the remaining length of same, the connecting strips 5 and 6 are preferably formed of discontinuous juxtaposed segments in order to limit the stress resulting from thermal contraction, in particular stress in the welds with the sheets 11.

Figure 7:
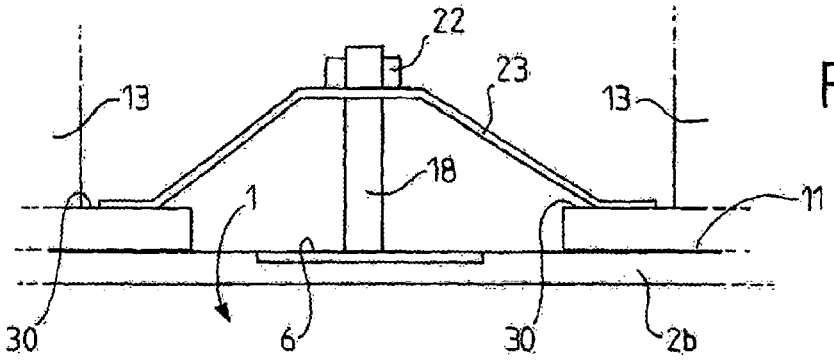
FIG. 7 is a schematic cross-section of attachment means according to an embodiment other than the one in FIGS. 5 and 6.
Figure 8:
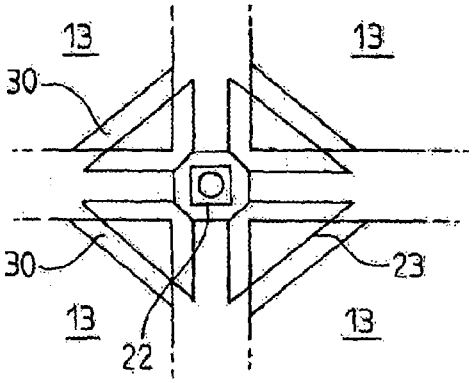
FIG. 8 is a top plan view of the attachment means in FIG. 7.

FIGS. 7 and 8 show a variant of the attachment means, which enable the insulated blocks 13 of the primary thermally insulated barrier to be pressed against the metal membrane 11 of the secondary impermeable barrier. These attachment means include a stud 18, the base of which is rigidly attached to the plywood plate 2*b* of the secondary thermally insulated block 1. An elastic spacer 23 is placed between nut 22 and the overhanging parts 30 of the plywood plates of the primary insulated blocks 13. This holds the insulated blocks 13 of the primary thermally insulated barrier of the tank on the secondary element of the tank without the stud 18 reaching the metal sheets 15 of the primary impermeable barrier.

In the figures, in particular FIG. 2, stress-relieving slots 40 are shown through approximately half of the thickness of the insulated blocks from the cover plate. These stress-relieving slots effectively subdivide the cover plates 2*b* and 13*b* into separate portions. However, such stress-relieving slots are not always necessary, depending on the properties of the material used to make the insulated blocks and the thermal stresses applied to same. In one embodiment that is not shown, an insulated block 1 or 13 has no stress-relieving slots, and as such the cover plate 2*b* or 13*b* is continuous.

FIGS. 9 to 12 concern the arrangements relating to the folds made in the metal sheets of the secondary impermeable barrier. These arrangements may also be used for the primary membrane.

Figure 9:
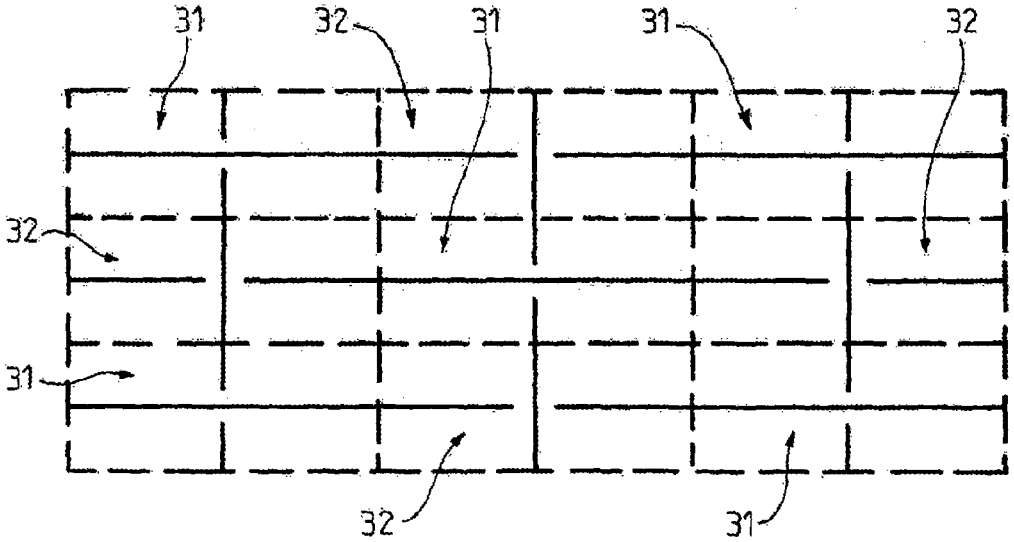
FIG. 9 shows an assembly diagram, in a tank wall, of the sheets making up the impermeable barrier, the sheets being of a first and second type, so that the flexibility of the metal membrane of the impermeable barrier is relatively uniform.

FIG. 9 shows the use of sheets having a continuous fold and a discontinuous fold orthogonal to the continuous fold. Two types of sheet 31 and 32 are arranged alternately. The edges of the sheets 31 and 32 are shown using broken lines. The folds are shown using unbroken lines. A membrane characterized by uniform flexibility in both directions is obtained.

Figure 10:
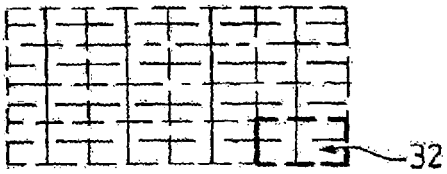
FIG. 10 shows an assembly diagram similar to the one in FIG. 9 for an alternative embodiment in which the folds of the metal sheet of the impermeable barrier that are arranged in a first direction are substantially aligned from one sheet of the tank wall to an adjacent sheet, while in the direction orthogonal to the first direction, the folds are interrupted to avoid the folds crossing.
Figure 11:
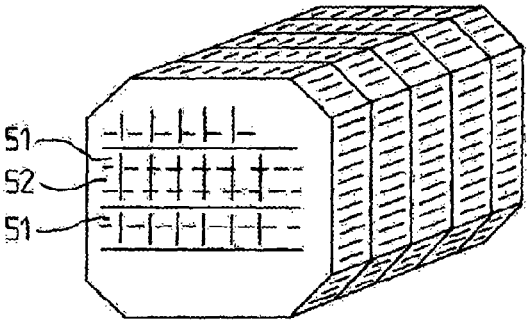
FIG. 11 is a schematic perspective view of a polyhedral tank section formed in an LNG carrier ship using the impermeable membrane shown in FIG. 10, which improves the flexibility of the impermeable membrane for deformations of the axis of the ship during maritime transport.

Conversely, FIG. 10 proposes using only sheet type 32, in which all of the folds in one direction are continuous folds, and the folds in the other direction are discontinuous folds. FIG. 11 shows that, for a tank designed to be fitted to a ship, the discontinuous folds are formed such that they are parallel to the axis of the ship and the continuous folds are formed such that they are perpendicular to said axis since, during transportation, the hull of the ship is deformed primarily by deformation of the axis of the ship in a vertical plane, due to pitching.

Figure 12:
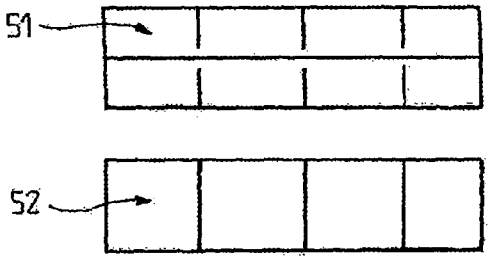
FIG. 12 is a schematic view of two other variants of metal sheets that can be used to form an impermeable membrane.

FIG. 12 shows two other sheets 51 and 52 that can be used to form the impermeable barrier at the partitions transverse to the axis of the ship, as shown in FIG. 11.

Figure 14:
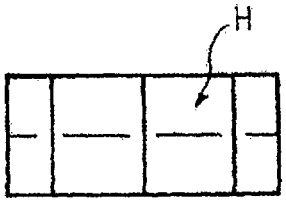
FIGS. 14 to 16 are schematic views of two other variants of metal sheets that can be used to form an impermeable membrane.
Figure 15:
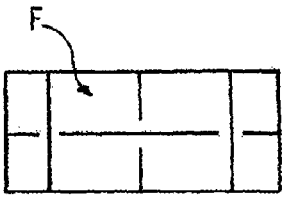

FIGS. 14 and 15 show creased sheets H and F that can be used instead of the sheets 51 and 52 in FIG. 11 to form the impermeable barrier at the partitions transverse to the axis of the ship. This results in rows of corrugations that are continuous along the width of the tank, but not in height.

Figure 16:
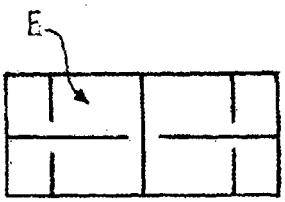

FIG. 16 shows a creased sheet E that can be used on its own or in combination with the preceding embodiments to form impermeable barriers.

Figure 17:
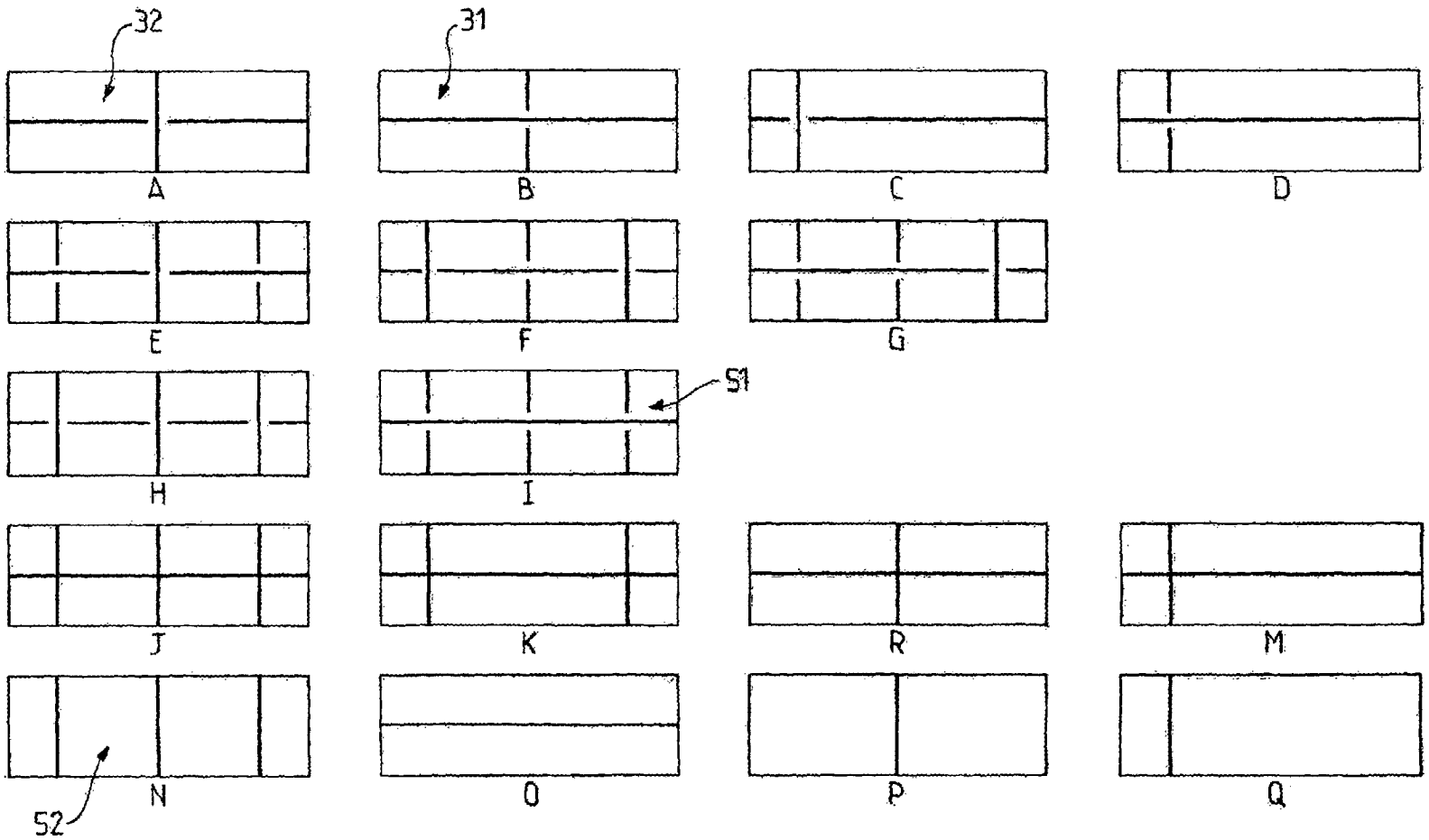
FIG. 17 is a schematic view of 17 embodiments of creased metal sheets that can be used to form an impermeable membrane.
Figure 19:
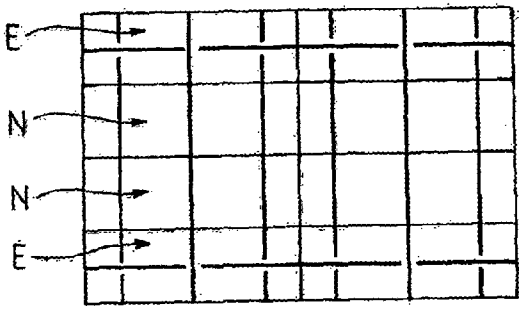
FIGS. 18 to 23 are schematic views of different layouts of the creased metal sheets of FIG. 17, which can be repeated periodically to form impermeable membranes.
Figure 21:
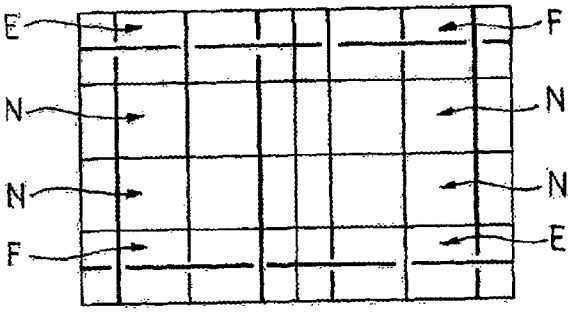

FIG. 17 shows different creased sheets A to R, including the examples given above and other examples, that can be used on their own or in multiple combinations to form the impermeable barriers.

The creased sheets A to R have in each instance simple folds or simple corrugations, which facilitates the assembly of same using impermeable welds. They may be combined in multiple layouts enabling in each instance a certain elongation of the metal membrane in both directions of the plane. The preferred layouts are shown in FIGS. 18 to 23.

Figure 23:
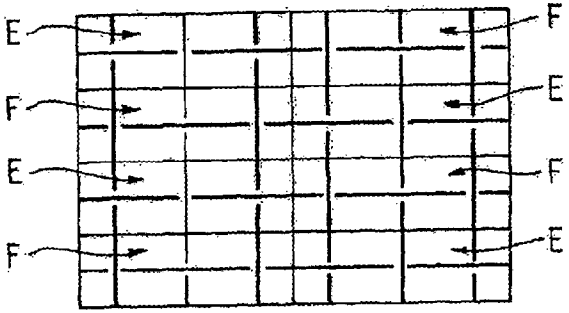
Figure 18:
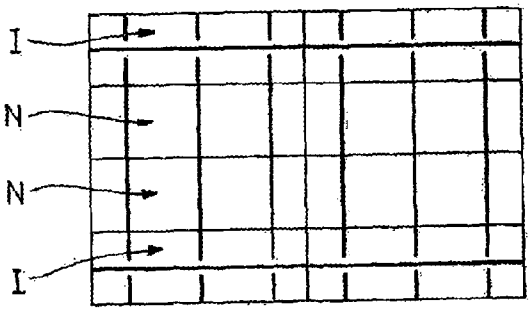
Figure 20:
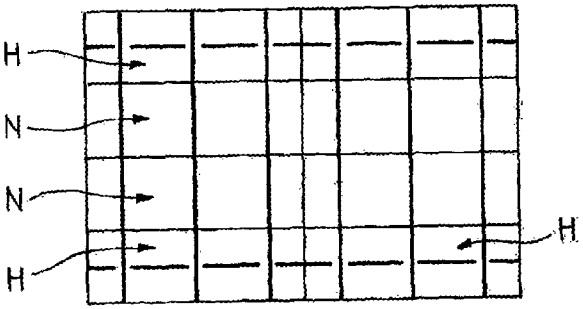
Figure 22:
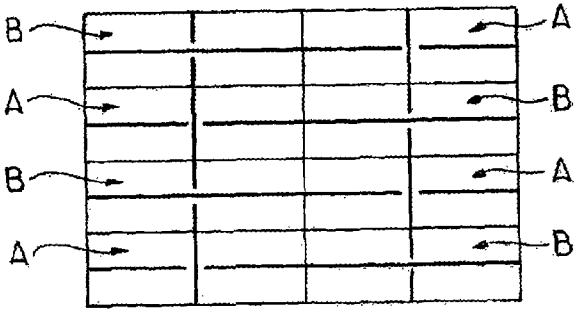

In a variant not shown, two types of sheet are alternated similarly to FIGS. 22 and 23, but in this case with sheets H and I from FIG. 17.

Figure 24:
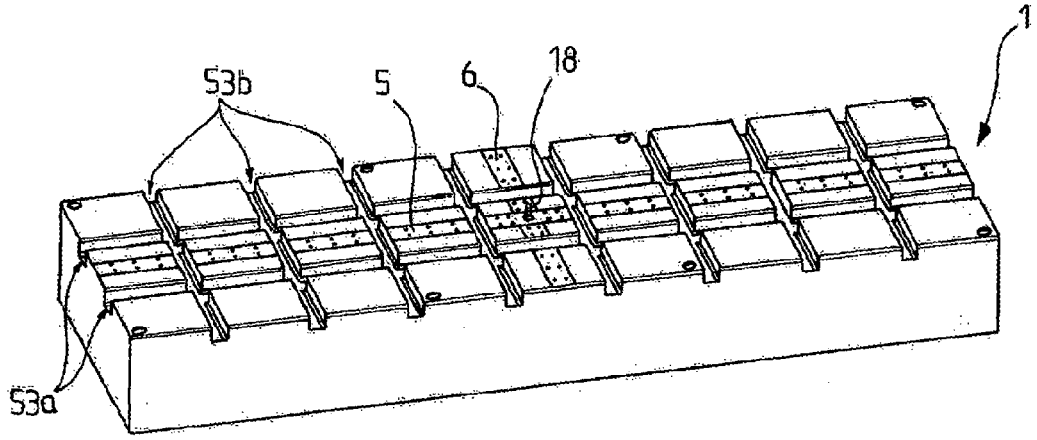
FIG. 24 is a perspective view of an insulated block of the thermally insulated barrier of the secondary element, according to another embodiment.
Figure 25:
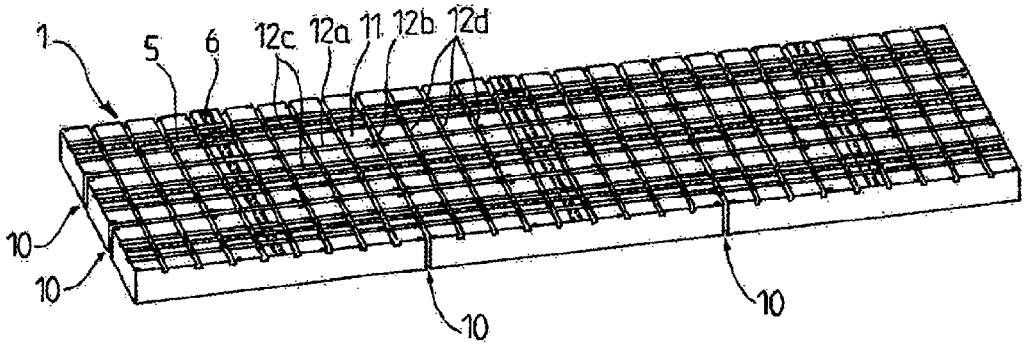
FIG. 25 is a perspective view of the impermeable and thermally insulated barriers of the secondary element according to the embodiment in FIG. 25, the impermeable barrier being shown partially removed.
Figure 26:
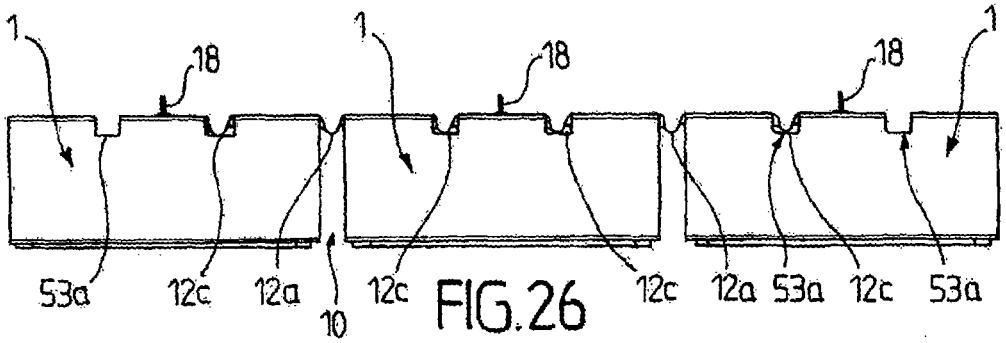
FIG. 26 is a cross-section of the impermeable and thermally insulated barriers of the secondary element according to the embodiment in FIGS. 24 and 25.

In one embodiment shown in FIGS. 24, 25 and 26, the insulated block 1 of the thermally insulated barrier of the secondary element includes two series of orthogonal slots 53*a*, 53*b*. Each of the series of slots 53*a*, 53*b* is parallel to two opposing sides of the insulated block 1. In this case, each insulated block 1 has two slots 53*a* extending in the longitudinal direction of same and eight slots 53*b* extending transversely to the longitudinal direction of same. The slots 53*a* extend along the entire length of the insulated block 1 and the slots 53*b* extend along the entire width of same. Consequently, the connecting strips 5, 6 onto which the edges of the sheets 11 of the secondary impermeable barrier are welded are in this case discontinuous.

Furthermore, as shown in FIG. 25, the metal sheets 11 of the secondary impermeable barrier include two series of folds 12*a*, 12*b*, 12*c*, 12*d*. Each series has folds that are perpendicular to the folds in the other series. Furthermore, each series has one of the orthogonal folds 12*a*, 12*b* seated in the gaps 10 formed between the insulated blocks 1, and a plurality of supplementary folds 12*c*, 12*d* that are parallel to said fold 12*a*, 12*b*. The supplementary folds 12*c*, 12*d* are identical to the folds 12*a* and 12*b* and form reliefs oriented towards the load-bearing wall 3. The supplementary folds are inserted into the slots 53*a*, 53*b* formed in the insulated blocks 1. Such an embodiment further increases the flexibility of the secondary impermeable barrier.

Figure 27:
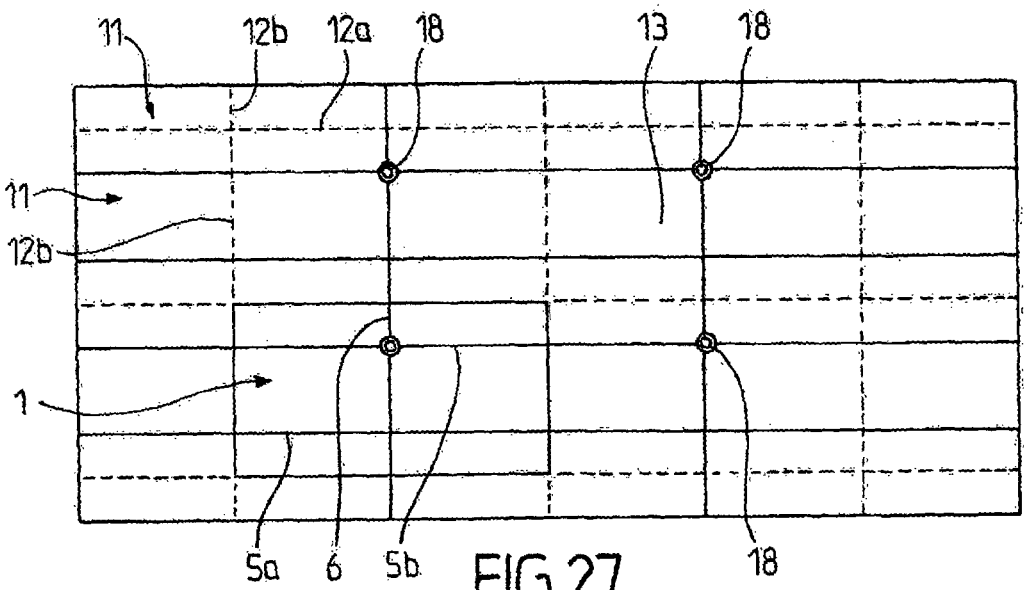
FIG. 27 is an assembly drawing, in a tank wall, of the sheets making up a secondary impermeable barrier, according to another embodiment.

In FIG. 27, the folds 12*a*, 12*b* of the sheets 11 of the metal membrane of the secondary element are shown using dotted lines. Furthermore, the position of an insulated block 1 of the secondary thermally insulated barrier 10 is shown, by means of transparency. The position of an insulated block 13 of the primary thermally insulated barrier attached to the insulated blocks 1 of the secondary thermally insulated barrier 10 is also shown. In this embodiment, the primary impermeable barrier has more sheets 11 than insulated blocks 1. In this case, the primary impermeable barrier has twice as many sheets 11 as insulated blocks 13. The length of the sheets 11 is therefore substantially equal to the length of the insulated blocks 1 and the width of same is substantially equal to half of the width of the insulated blocks. Consequently, a part of the sheets 11 is welded in an overlapping manner to four adjacent insulated blocks 1. The other part of the sheets 11 is welded in an overlapping manner to just two adjacent insulated blocks 1. To attach the sheets to the insulated blocks 1, they have three connecting strips 5*a*, 5*b*, 6. The connecting strip 5*a* is oriented transversely to the insulated block 1. The connecting strips 5*a*, 5*b* are arranged in the longitudinal direction of the insulated block 1.

The sheets 11 welded in an overlapping manner onto four adjacent insulated blocks 1 each have orthogonal folds 12*a*, 12*b* inserted into the gaps 10 formed between the insulated blocks 1. Each of the sheets 11 welded in an overlapping manner onto to adjacent insulated blocks 1 has only one fold 12*b* inserted between the two adjacent insulated blocks 1 between which it extends.

At the center of the crossings between the connecting strip 6 and the connecting strips 5*a*, 5*b*, the insulated blocks 1 include a stud 18 projecting towards the inside of the tank and enabling attachment of the insulated blocks 13 of the primary thermally insulated barrier.

Figure 28:
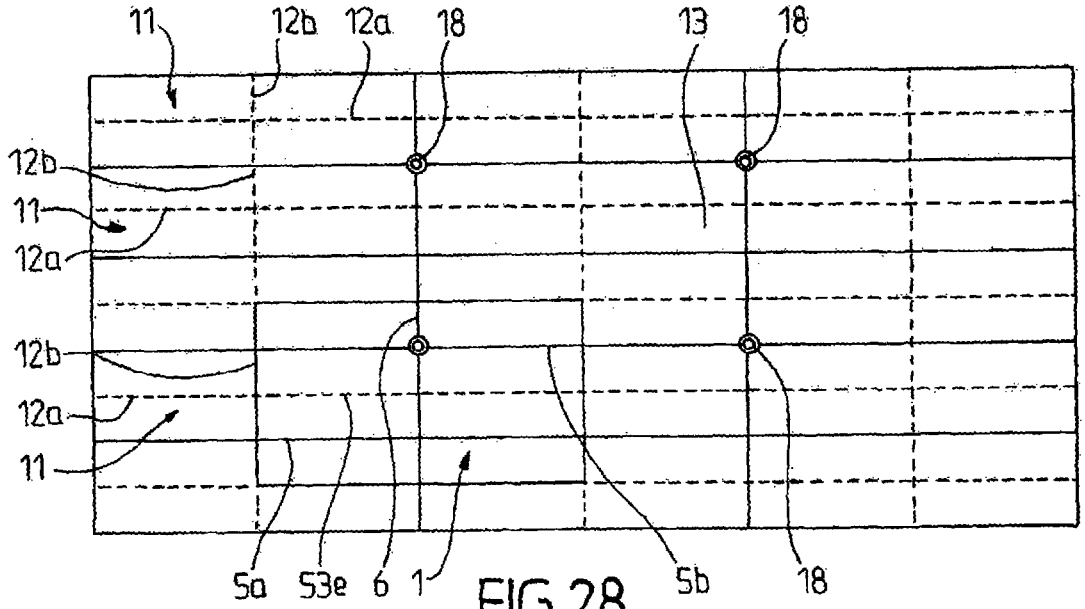
FIG. 28 is an assembly diagram, in a tank wall, of the sheets making up a secondary impermeable barrier, according to another embodiment.

The embodiment shown in FIG. 28 is substantially similar to the embodiment in FIG. 27. However, in this embodiment, the sheets 11 are identical and each have two orthogonal folds 12*a*, 12*b*. Consequently, the insulated blocks 1 include a median slot 53*e* extending in the longitudinal direction of same. The median slots 53*e* enable seating of the folds 12*a* extending in the longitudinal direction of the sheets 11 welded in an overlapping manner to two adjacent insulated blocks 1.

Other variants of corrugated sheets and other combinations can be realized by changing the different features, in particular the spacing of the corrugations, the number of corrugations per sheet, the length of the discontinuous corrugations (number of steps), the form of the intersections between the corrugations, namely intersecting or non-intersecting, the orientation of the continuous corrugations, namely longitudinal or transverse orientation, and the orientation of the sheets themselves, namely horizontal orientation or vertical orientation (90° rotation), and the combinations of such modifications.

The tanks described above may be used in different types of facilities such as onshore facilities or in a floating structure such as an LNG carrier ship or other.

Figure 13:
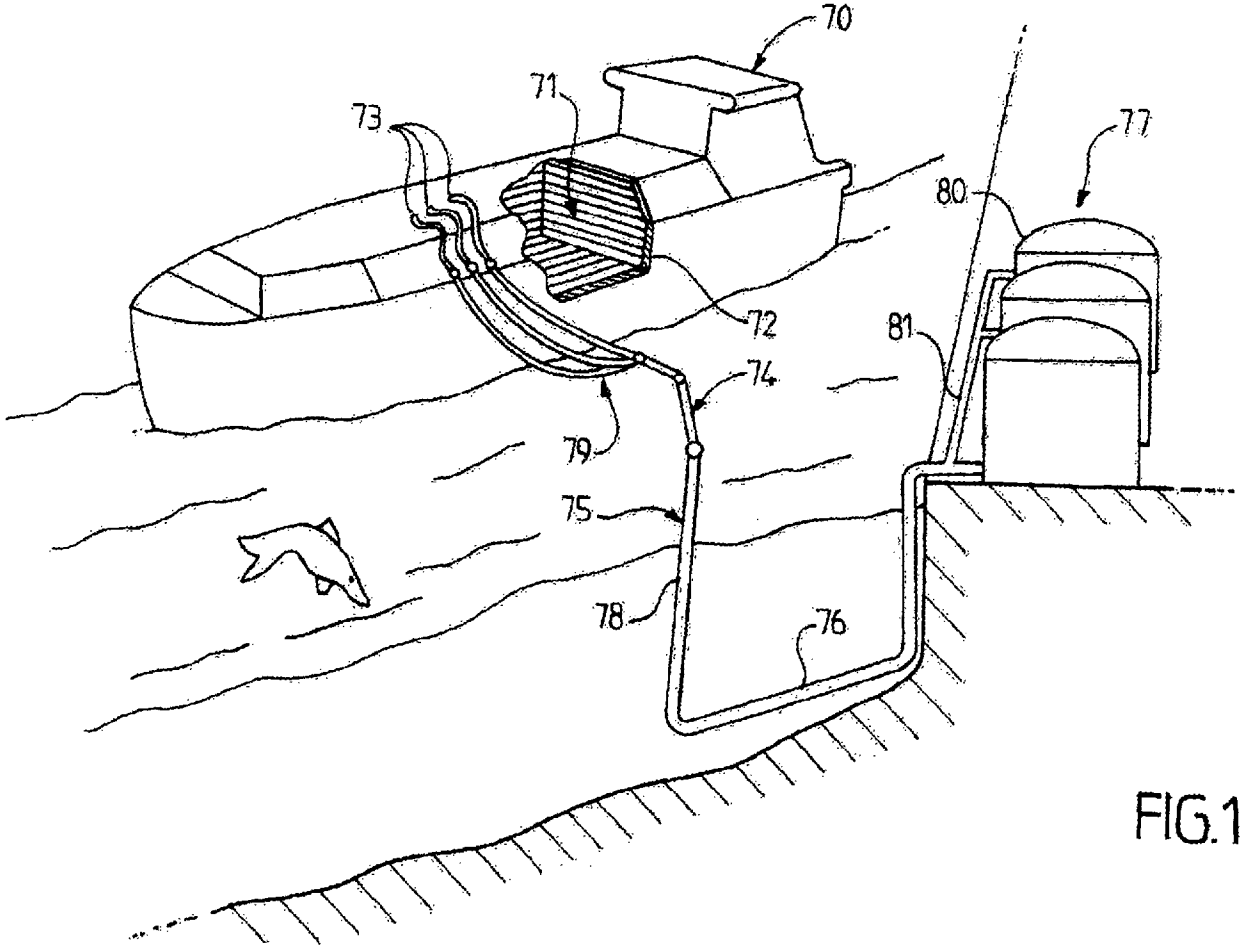
FIG. 13 is a cut-away schematic view of an LNG carrier ship tank and of a loading/offloading terminal for the tank.

With reference to FIG. 13, a cut-away view of an LNG carrier ship 70 shows an impermeable insulated tank 71 having an overall prismatic shape mounted in the double hull 72 of the ship. The wall of the tank 71 has a primary impermeable barrier designed to be in contact with the LNG contained in the tank, a secondary impermeable barrier arranged between the first impermeable barrier and the double hull of the ship, and two thermally insulated barriers arranged respectively between the first impermeable barrier and the second impermeable barrier, and between the second impermeable barrier and the double hull 72.

In a known manner, the loading/offloading pipes arranged on the upper deck of the ship can be connected, using appropriate connectors, to a sea or port terminal to transfer a cargo of LNG to or from the tank 71.

FIG. 13 shows an example of a sea terminal comprising a loading/offloading station 75, an underwater duct 76 and an onshore facility 77. The loading/offloading station 75 is a fixed offshore installation comprising a movable arm 74 and a column 78 holding the movable arm 74. The movable arm 74 carries a bundle of insulated hoses 79 that can connect to the loading/offloading pipes 73. The orientable movable arm 74 can be adapted to all sizes of LNG carrier ships. A linking duct (not shown) extends inside the column 78. The loading/offloading station 75 makes loading and offloading of the LNG carrier ship 70 possible to or from the onshore facility 77. This facility has liquefied gas storage tanks 80 and linking ducts 81 connected via the underwater duct 76 to the loading/offloading station 75. The underwater duct 76 enables liquefied gas to be transferred between the loading/offloading station 75 and the onshore facility 77 over a large distance, for example 5 km, which makes it possible to keep the LNG carrier ship 70 a long way away from the coast during loading and offloading operations.

To create the pressure required to transfer the liquefied gas, pumps carried on board the ship 70 and/or pumps installed at the onshore facility 77 and/or pumps installed on the loading/offloading station 75 are used.

Although the invention has been described in relation to several specific embodiments, it is evidently in no way limited thereto and it includes all of the technical equivalents of the means described and the combinations thereof where these fall within the scope of the invention.

Use of the verb "comprise" or "include", including when conjugated, does not exclude the presence of other elements or other steps in addition to those mentioned in a claim. Use of the indefinite article "a" or "one" for an element or a step does not exclude, unless otherwise specified, the presence of a plurality of such elements or steps.

The invention claimed is:

1. An impermeable and thermally insulated tank built into a structure that includes a load-bearing wall, said tank having a tank wall attached to said load-bearing wall, the tank wall comprising:

a thermally insulated barrier held on the load-bearing wall and made up of cuboid thermally insulated blocks, juxtaposed in parallel rows separated from one another by gaps, an impermeable barrier carried by the thermally insulated barrier, said impermeable barrier comprising a metal membrane formed of metal sheets welded together sealingly, at least some of the insulated blocks of the thermally insulated barrier carrying, on the face of same opposite the load-bearing wall, at least two substantially orthogonal metal connecting strips, arranged parallel to the sides of the insulated block, the sheets of the metal membrane carried by said insulated block being welded to said strips, said connecting strips being rigidly connected to the insulated block bearing same, the adjacent metal sheets of the impermeable barrier being welded in an overlapping manner on top of the connecting strips carried respectively by the thermally insulated barrier;

a plurality of sheets of the metal membrane each having at least two orthogonal folds parallel to the sides of the thermally insulated blocks, said folds being inserted in the gaps formed between the insulating blocks.

2. The tank as claimed in claim 1, wherein the tank wall has a primary element and a secondary element arranged between the load-bearing wall and the primary element, both the primary element and the secondary element including a thermally insulated barrier made up of cuboid thermally insulated blocks, juxtaposed in parallel rows and both the primary and secondary elements including an impermeable barrier arranged on the thermally insulated barrier, the thermally insulated barrier of the secondary element being rigidly connected to the load-bearing wall, the thermally insulated barrier of the primary element being rigidly connected using attachment means connected to the thermally insulated barrier of the secondary element.

3. The tank as claimed in claim 2, wherein the impermeable barrier of the secondary element is formed by the metal membrane comprising a plurality of sheets each having at least two orthogonal folds parallel to the sides of the thermal insulated blocks, inserted in the gaps formed between the insulated blocks of the secondary element.

4. The tank as claimed in claim 3, wherein the sheets of the metal membrane of the secondary element are made of an iron alloy with nickel or manganese, having a coefficient of expansion not exceeding $7\times10^{-6}$ $K^{-1}$.

5. The tank as claimed in claim 2, wherein the impermeable barrier of the primary element is formed of metal sheets welded together sealingly, with folds oriented towards the inside of the tank.

6. The tank as claimed in claim 2, wherein the insulated block of the thermally insulated barrier has a base plate on which is arranged a foam layer, the base plate overhanging the foam.

7. The tank as claimed in claim 6, wherein the insulated block of the thermally insulated barrier of the secondary element is pressed against the load-bearing wall using fixtures welded to the load-bearing wall and cooperating with the overhanging zones of the base plate of the insulated block.

8. The tank as claimed in claim 2, wherein the insulated block of the thermally insulated barrier of the secondary element is held on the load-bearing wall by bonding.

9. The tank as claimed in claim 2, wherein each insulated block of the thermally insulated barrier of the secondary element carries the two connecting strips that are arranged along the two axes of symmetry of the rectangle defined by a large face of said insulated block.

10. The tank as claimed in claim 9, wherein the attachment means of the thermally insulated barrier of the primary element include a continuous metal plate arranged at the intersection of the two connecting strips at the center of the rectangle of each insulated block of the secondary element such as to form an impermeable zone to which the corners of the four sheets can be welded around said attachment means, and a projecting member crossing the impermeable barrier of the secondary element without reaching the impermeable barrier of the primary element.

11. The tank as claimed in claim 10, wherein the projecting members are studs, the bases of which are attached to the continuous metal plate placed at the intersection of the two connecting strips of the insulated block of the secondary element, an intermediate part being interposed between firstly a nut cooperating with the thread provided at the free extremity of the stud and secondly the overhanging parts of the plates of the insulated blocks of the thermally insulated barrier of the primary element.

12. The tank as claimed in claim 2, wherein each insulated block of the thermally insulated barrier of the primary element has two connecting strips that are arranged in the vicinity of the edges of a large face of said insulated block.

13. The tank as claimed in claim 1, wherein the connecting strips of the insulated block are seated in recesses formed in the insulated block bearing same so as not to increase the thickness on the corresponding face of the insulated block.

14. The tank as claimed in claim 13, wherein the connecting strip of the insulated block is attached to the recess of same by screwing, riveting, stapling or bonding.

15. The tank as claimed in claim 1, wherein the metal sheets, which form the impermeable barrier, are rectangular and each have two folds formed along the axes of symmetry of the rectangle formed by the edges of the rectangular sheet.

16. The tank as claimed in claim 15, wherein the two folds of the sheet of the impermeable barrier intersect at the center of the rectangular sheet.

17. The tank as claimed in claim 15, wherein one of the folds of the sheet of the impermeable barrier is continuous and the other is interrupted in the central portion of same.

18. The tank as claimed in claim 17, wherein the impermeable barrier includes sheets of a first type that have a continuous fold along the major axis of same and sheets of a second type that have a continuous fold along the minor axis of same, the first and second types of sheet alternating regularly on a tank wall so that one sheet of one of the types is always surrounded by four sheets of the other type arranged along the four sides of same.

19. The tank as claimed in claim 1, wherein each insulated block of the thermally insulated barrier has two series of orthogonal slots, each of said series having slots arranged parallel to two opposing sides of the insulated block, and in that the sheets of the metal membrane each have two series of supplementary folds, each of said series of supplementary folds having folds orthogonal to the folds in the other series, parallel to one of the two folds inserted in the gaps, and inserted into the slots of one of the series of slots formed in the insulated block.

20. The tank as claimed in claim 1, wherein the metal membrane has a second plurality of sheets, each of the sheets in the second plurality having a single fold parallel to two opposing sides of the insulated blocks, said fold being inserted into a gap formed between two insulated blocks.

21. The tank as claimed in claim 1, wherein each insulated block of the thermally insulated barrier has a slot parallel to two opposing sides of the insulated blocks and in which the metal membrane has a second plurality of sheets, each of the sheets in the second plurality having a fold inserted in a slot formed in an insulated block and a fold inserted in a gap formed between two insulated blocks.

22. A ship used to transport a liquid product, the ship having a double hull and a tank as claimed in claim 1 placed inside the double hull.

23. A method of using a ship as claimed in claim 22 for loading or offloading a liquid product, comprising the step of channeling a liquid product through insulated pipes to or from an onshore or floating storage facility to or from the tank on the ship.

24. A transfer system for a liquid product, the system including a ship as claimed in claim 22, insulated pipes arranged to connect the tank installed in the hull of the ship to an onshore or floating storage facility and a pump for driving a flow of liquid product through the insulated pipes to or from the onshore or floating storage facility to or from the tank on the ship.

25. The tank as claimed in claim 2, wherein the attachment means of the thermally insulated barrier of the primary element include a continuous metal plate arranged at the intersection of the two connecting strips to form an impermeable zone to which the corners of the four sheets can be welded around said attachment means, and a projecting member crossing the impermeable barrier of the secondary element without reaching the impermeable barrier of the primary element.

26. The tank as claimed in claim 1, wherein the plurality of sheets of the metal membrane each having at least two orthogonal folds inserted in the gaps formed between the insulating blocks are welded to the connecting strips.

27. The tank as claimed in claim 1, wherein the plurality of sheets of the metal membrane each having at least two orthogonal folds inserted in the gaps formed between the insulating blocks are juxtaposed and are welded together sealingly.

28. The tank as claimed in claim 1, wherein each insulating block of the thermally insulated barrier is covered by at least four sheets of the plurality of sheets of the metal membrane each having at least two orthogonal folds inserted in the gaps formed between the insulating blocks.

29. The tank as claimed in claim 1, wherein the two metal connecting strips that are carried by each insulating block of the thermally insulated barrier are arranged along the two axes of symmetry of a rectangle defined by a large face of said insulating block;

wherein the plurality of sheets of the metal membrane each having at least two orthogonal folds inserted in the gaps formed between the insulating blocks are welded to the connecting strip and are rectangular, the orthogonal folds being formed along the axes of symmetry of the rectangle formed by the edges of the rectangular sheet.

30. An impermeable and thermally insulated tank built into a structure that includes a load-bearing wall, said tank having a tank wall attached to said load-bearing wall, the tank wall comprising:

a thermally insulated barrier held on the load-bearing wall and made up of cuboid thermally insulated blocks, juxtaposed in parallel rows separated from one another by gaps, an impermeable barrier carried by the thermally insulated barrier, said impermeable barrier comprising a metal membrane formed of metal sheets welded together sealingly, at least some of the insulating blocks of the thermally insulated barrier carrying, on the face of same opposite the load-bearing wall at least two substantially orthogonal metal connecting strips, arranged parallel to the sides of the insulating block, the sheets of the metal membrane carried by said insulating block being welded to said strips, said connecting strips being rigidly connected to the insulating block bearing same, a plurality of sheets of the metal membrane each having at least two orthogonal folds parallel to the sides of the thermal insulating blocks, said folds being inserted in the gaps formed between the insulating blocks;

wherein each insulating block of the thermally insulated barrier has two series of orthogonal slots, each of said series having slots arranged parallel to two opposing sides of the insulating block, and in that the sheets of the metal membrane each have two series of supplementary folds, each of said series of supplementary folds having folds orthogonal to the folds in the other series, parallel to one of the two folds inserted in the gaps, and inserted into the slots of one of the series of slots formed in the insulating block.

31. An impermeable and thermally insulated tank built into a structure that includes a load-bearing wall, said tank having a tank wall attached to said load-bearing wall, the tank wall comprising:

a thermally insulated barrier held on the load-bearing wall and made up of cuboid insulating blocks, juxtaposed in parallel rows separated from one another by gaps, an impermeable barrier carried by the thermally insulated barrier, said impermeable barrier comprising a metal membrane formed of metal sheets welded together sealingly, at least some of the insulating blocks of the thermally insulated barrier carrying, on the face of same opposite the load-bearing wall at least two substantially orthogonal metal connecting strips, arranged parallel to the sides of the insulating block, the sheets of the metal membrane carried by said insulating block being welded to said strips, said connecting strips being rigidly connected to the insulating block bearing same, a plurality of sheets of the metal membrane each having at least two orthogonal folds parallel to the sides of the thermal insulating blocks, said folds being inserted in the gaps formed between the insulating blocks;

wherein each insulating block of the thermally insulated barrier has a slot parallel to two opposing sides of the insulating blocks and in which the metal membrane has a second plurality of sheets, each of the sheets in the second plurality having a fold inserted in a slot formed in an insulating block and a fold inserted in a gap formed between two insulating blocks.

* * * * *